US007285504B2

(12) United States Patent
Jones et al.

(10) Patent No.: US 7,285,504 B2
(45) Date of Patent: Oct. 23, 2007

(54) WET TENSILE STRENGTH OF NONWOVEN WEBS

(75) Inventors: Ronald Bernal Jones, Allentown, PA (US); Blaine Richard Hobar, Ashfield, PA (US); Joel Erwin Goldstein, Allentown, PA (US); Lloyd Mahlon Robeson, Macungie, PA (US)

(73) Assignee: Air Products Polymers, L.P., Allentown, PA (US)

( * ) Notice: Subject to any disclaimer, the term of this patent is extended or adjusted under 35 U.S.C. 154(b) by 312 days.

(21) Appl. No.: 10/830,558

(22) Filed: Apr. 23, 2004

(65) Prior Publication Data

US 2005/0239359 A1 Oct. 27, 2005

(51) Int. Cl.
*B32B 27/04* (2006.01)
*B32B 5/02* (2006.01)
*B32B 27/30* (2006.01)

(52) U.S. Cl. ..... 442/149; 442/154; 442/155

(58) Field of Classification Search ..... 442/149, 442/154, 155

See application file for complete search history.

(56) References Cited

U.S. PATENT DOCUMENTS

| | | | | |
|---|---|---|---|---|
| 3,137,589 A | | 6/1964 | Reinhard et al. | |
| 3,380,851 A | | 4/1968 | Lindemann et al. | |
| 3,561,447 A | * | 2/1971 | Alexander | 604/364 |
| 3,752,733 A | | 8/1973 | Graham et al. | |
| 3,758,429 A | | 9/1973 | Fallwell et al. | |
| 4,245,744 A | | 1/1981 | Daniels et al. | |
| 4,309,469 A | * | 1/1982 | Varona | 428/74 |
| 4,449,978 A | | 5/1984 | Iacoviello | |
| 4,590,102 A | * | 5/1986 | Rosamilia et al. | 427/374.1 |
| 5,252,332 A | | 10/1993 | Goldstein | |
| 5,256,417 A | | 10/1993 | Koltisko | |
| 5,281,306 A | * | 1/1994 | Kakiuchi et al. | 162/158 |
| 5,384,189 A | | 1/1995 | Kuroda et al. | |
| 5,509,913 A | | 4/1996 | Yeo | |
| 5,629,081 A | | 5/1997 | Richards et al. | |
| 5,883,019 A | | 3/1999 | Troung et al. | |
| 5,972,805 A | | 10/1999 | Pomplun et al. | |

FOREIGN PATENT DOCUMENTS

| | | |
|---|---|---|
| WO | WO 99/18269 | 4/1999 |
| WO | WO 00/39378 | 7/2000 |

* cited by examiner

*Primary Examiner*—Lynda Salvatore
(74) *Attorney, Agent, or Firm*—Mary E. Bongiorno

(57) ABSTRACT

The present invention is directed to an improvement in the wet tensile of a nonwoven web, whether the web is for a pre-moistened nonwoven wet wipe that is both safe to use and also flushes, disperses and finally biodegrades in appropriate environments or for a nonwoven web which requires high tensile strength when in contact with liquids. An improvement in the wet tensile of the nonwoven webs is achieved by incorporating a finite amount of poly(acrylic acid) into a polymeric binder system that is applied to the web.

20 Claims, No Drawings

WET TENSILE STRENGTH OF NONWOVEN WEBS

BACKGROUND OF THE INVENTION

The issue of disposability of products is of great concern to the nonwovens industry. Among the different types of disposable nonwovens are pre-moistened nonwovens which are readily dispersible in large amounts of water or liquids, and absorbent, disposable nonwovens that can be used as wipes and require a high level of strength after contact with liquids.

With regard to dispersible nonwovens, the industry wishes to offer pre-moistened toilet tissue on a roll and pre-moistened wipes that will be truly flushable and dispersible. In another words, the tissues or wipes must disintegrate in toilet water under gentle agitation without the addition of temperature or chemicals.

Wet-packaged skin cleansing and refreshing tissues are well-known commercially, and generally referred to as towelettes, wet wipes, fem wipes and the like. These may comprise an absorbent sheet made of paper, prepared or treated to impart wet strength thereto, having the dimensions of the usual washcloth and packaged wet in folded condition, individually in impervious envelopes or in multiples in closed containers. The liquid employed in the pre-moistening of the wet-packaged bonded nonwoven web is generally an aqueous composition, or lotion, which may further contain a surface active agent and a humectant and, in some instances, a scenting agent. Instead of individual packaging of such moist sheets, they are often marketed in reclosable containers having any desired convenient number of such folded sheets.

Water soluble or redispersible polymeric binders have been used in making nonwoven substrates and they are generally comprised of poly(vinyl alcohol) (PVOH), PVOH-stabilized vinyl acetate or vinyl acetate based polymers, e.g., vinyl acetate-ethylene (VAE) emulsion polymers. Some of the technical problems associated with pre-moistened wipes and tissues include: (1) providing sufficient water soluble or dispersible binder in the nonwoven wipe to provide sufficient dry and wet tensile strength for manufacture and use in its intended application and (2) protecting the water redispersible polymer in the wipe or tissue from attack by the aqueous composition during storage.

Several mechanisms have been proposed to address disintegration of the pre-moistened wipe prior to use. One method employs the addition of boric acid or derivatives to the aqueous lotion composition to maintain the integrity of the wet nonwoven substrate. However, boric acid and its derivatives have fallen into disfavor due to the perception as to their potential harmful effects near mucous membranes.

Another mechanism for preventing dissolution of the wipe has been the inclusion of high levels of alkali metal bicarbonates and salts to prevent as the aqueous lotion from slowly dissolving the PVOH allowing this protective colloid to redisperse the polymer binder. A problem of alkali metal bicarbonates is that they can decompose slowly to carbon dioxide and evaporate out of the solution.

The following patents and articles are illustrative of the prior art:

U.S. Pat. No. 4,245,744 discloses nonwoven fiber sheets impregnated with PVOH-containing vinyl acetate-based polymers in which the nonwoven sheets are maintained in contact with a dilute aqueous solution of a precipitating or gelling agent for PVOH, such as boric acid.

U.S. Pat. No. 5,252,332 discloses a packaged towelette comprising a sheet of nonwoven fibers impregnated with PVOH or a PVOH-containing binder in contact with an aqueous solution containing boric ions and bicarbonate ions.

U.S. Pat. No. 5,629,081 discloses a pre-moistened, dispersible and biodegradable wet wipe comprising a web of nonwoven fibers contacted with a PVOH-containing binder. The binder-contacted web further comprises an aqueous lotion solution comprising 0.1-0.9 wt % boric acid and 5-8 wt % alkali metal bicarbonate, based on weight of the lotion.

U.S. Pat. No. 5,384,189 discloses a water decomposable nonwoven fabric in which the fibers are bonded to one another with a water-soluble binder comprising an unsaturated carboxylic acid/unsaturated carboxylic acid ester copolymer in which 1-60 mole % of the repeating units derived from the carboxylic acid is in the form of a salt. The binder is soluble in tap water but is insoluble in an aqueous solution containing not less than 0.5 wt % of a neutral inorganic salt comprising a monovalent ion.

U.S. Pat. No. 5,972,805 discloses a water-soluble polymeric binder composition for use in making nonwoven webs comprising 25-90 wt % unsaturated carboxylic acid/unsaturated carboxylic acid esters/ester copolymer, 10-75 wt % divalent ion inhibitor and 0-10 wt % plasticizer. The water-soluble binder composition is soluble in an aqueous environment having a divalent ion concentration listing about 50 ppm and a monovalent concentration of less than about 0.5 wt %.

U.S. Pat. No. 5,256,417 which discloses a packaged towelette which is disposable comprises a sheet of nonwoven fibers impregnated with a binder, e.g., PVOH or an aqueous polymer emulsion containing PVOH as a protective colloid. The sheet is maintained in a wet condition within the package by contact with a non-aqueous lotion composition which is a liquid organic compound that is a non-solvent for PVOH.

WO 99/18269 and WO 00/39378 disclose disposable products which are flushable. A feature of the flushable product is that it have sufficient wet strength for its intended use but loses its structural integrity upon contact with water. Ion sensitive, "temperature sensitive" compositions are employed in forming the disposable product and comprise a blend of at least one water-sensitive polymer and at least one polylactide, polyolefin-grafted with a polar group, e.g., maleic acid. Dispersiblity depends upon the amount of monovalent or multivalent ions in the aqueous solution.

Additionally nonwoven products are utilized for the preparation of absorbent, disposable products such as wipers. These nonwoven products or fabrics are also comprised of loosely assembled webs or masses of fibers bound together with an adhesive polymeric binder. These fibers have been comprised of cellulosic or polymeric materials such as polyesters, polyamides, polyacrylates and the like. However, these nonwoven products are expected to retain a high level of strength after contact with liquids. They are typically used to clean countertops, windows and many other hard surfaces. Many of the adhesive polymers for these nonwoven webs have been based upon water-based polymers of vinyl acetate, ethylene and a self crosslinking monomer, e.g., N-methylol acrylamide (NMA) or equivalent formed by emulsion polymerization The incorporation of a self crosslinking monomer provides for enhanced wet strength and resistance to organic solvents.

The following patents are representative of the art:

U.S. Pat. No. 3,380,851 discloses a nonwoven binder comprised of a polymer of vinyl acetate, another polymerizable compound as an internal plasticizer, and a postcurable comonomer such as N-methylol acryiamide bonded to loosely assembled fibers. A wide variety of fibers based upon natural and synthetic fibers which include cellulose, wool, polyamides, polyesters, polyethylene and so forth are disclosed.

U.S. Pat. No. 4,449,978 discloses nonwoven webs of the type disclosed in U.S. Pat. No. 3,380,851 bonded with low formaldehyde generating adhesive polymers. Specific systems are based upon vinyl acetate, ethylene and a blend of acrylamide and N-methylol acrylamide.

U.S. Pat. No. 3,758,429 discloses adhesive binders based upon terpolymers of ethylene, vinyl chloride and N-methylol acrylamide for use in producing nonwoven webs. The terpolymers are provided to enhance wet strength.

U.S. Pat. No. 3,752,733 discloses nonwoven products based upon fibers from both natural and synthetic sources bonded with an ethylene/vinyl chloride/acrylamide terpolymer. The patentees disclose curing these polymers with sulfur compounds to provide increased tensile strength, softness, flexibility and so forth.

U.S. Pat. No. 3,137,589 discloses binders comprising a copolymer of an alpha, beta-unsaturated carboxylic acid amide substituted on the nitrogen by at least one methylol group and another unsaturated polymerizable compound for use in preparing nonwoven webs.

Historically, to achieve desirable or sufficient wet tensile strength it has been common practice to elevate the dry tensile strength of the polymer or use higher add-on levels of polymer. However, the level of wet tensile typically plateaus at a performance level below what is now required and increasing the level of self-crosslinking monomer does not enhance performance. Higher dry tensile strengths in a nonwoven product tends to impart stiffness or a hardness to the product and make it uncomfortable to the touch.

SUMMARY OF THE INVENTION

The invention relates to a polymeric binder system for improving the wet tensile strength of nonwoven products. The basic polymeric binder is comprised of polymerized units of ethylenically unsaturated monomers, is formed by emulsion polymerization, and formulated for application to nonwoven products. Typically the polymeric binder may contain vinyl acetate, ethylene, vinyl chloride, vinyl versatate, alkyl (meth)acrylates, styrene, butadiene and/or other unsaturated monomers such as dioctyl maleate. If it is desired to have a nonwoven product that has high strength when in contact with any liquid, the binder should also contain self-crosslinking monomer(s), e.g., N-methylol acrylamide (NMA). An improvement in the wet tensile of the nonwovens web is achieved by incorporating a finite amount of poly(acrylic acid) (PAA) into the binder. Another possible significant advantage includes an ability to reduce the level of free formaldehyde through the use of reduced binder levels at equivalent strength.

Summarizing, the chief advantage of this polymeric binder system is that the polymeric binder exhibits improved strength of nonwoven webs when they are moistened. Using the polymeric binder system of this invention results in increased strength in nonwovens webs and requires less binder compared to what is commercially possible using known VAE-based binder systems and allowing for manufacturing structures with equivalent strength to those currently commercially available. By using less binder, a raw material savings is realized and a performance advantage is also realized because it would provide a finished product with a lower formaldehyde level, less streaking, improved absorbency as well as softer hand. This improvement is achievable whether the wet strength is permanent (using a crosslinking comonomer) or reversible (specialty pre-moistened wipes using a lotion with a relatively low level of insolubilizing salts as compared to those disclosed in the prior art).

Where a reversible crosslink is required in order to enable redispersion in liquids, the present invention relates to an improvement in a pre-moistened wet wipe comprising a nonwoven web, or substrate, of fibers bonded with a water redispersible polymeric binder in contact with an aqueous composition, e.g., a lotion containing a water binding salt. The improvement resides in a polymeric binder composition comprised of a blend, said blend comprising, on a dry weight basis:

65 to 85 percent by weight of a said water redispersible polymer emulsion;

13 to 30 percent by weight of poly(vinyl alcohol); and, 1-7 percent by weight poly(acrylic acid).

The present invention provides a pre-moistened wipe having the following advantages:

- long shelf life;
- good tensile strength in the aqueous lotion;
- good dry tensile strength and elongation required for manufacturing;
- freedom from having to use boric acid or its derivatives in the aqueous lotion;
- rapid disintegration of the disposed, used wipe under the ambient conditions of typical tap water and water-containing toilets including working regardless of the degree of hardness in the water;
- an ability to eliminate plasticizers, such as a polyethylene glycol due to the good hand feel that the binders have when pre-moistened wipes, and,
- an ability to employ less insolubilizing salt thereby dramatically reducing/eliminating the concern of irritation and of imparting a stinging sensation.

Where the nonwoven product requires wet strength in the presence of any, liquid, the present invention relates to an improvement in the wet tensile of the nonwoven web by incorporating poly(acrylic acid) into the binder. The improvement resides in a polymeric binder composition comprised of a blend, said blend comprising, on a dry weight basis:

90 to 99.9 percent by weight of a self-crosslinkable latex polymer; and 0.1-10 percent by weight poly(acrylic acid).

DETAILED DESCRIPTION OF THE INVENTION

The present invention is directed to an improvement in the wet tensile of a nonwoven web, whether the web is for a pre-moistened nonwoven wet wipe that is both safe to use and also flushes, disperses and finally biodegrades in appropriate environments or for a nonwoven web which requires high tensile strength when in contact with liquids. The term "wet wipe" for purposes of the present invention means a pre-moistened nonwoven web of fibers that can be used, for example, for cleansing purposes and includes items such as towelettes, wipes, e.g., baby wipes, hemorrhoid wipes, feminine hygiene wipes, bedridden patient wipes, bathroom cleaning wipes and the like, and pre-moistened toilet paper. The term "dispersible" means the ability of the nonwoven wet wipe to disintegrate readily in toilet water or other aqueous medium with mild agitation.

Dispersible nonwoven pre-moistened wet wipes are comprised of a nonwoven fibrous material bonded with a water soluble or redispersible polymeric binder in contact with an aqueous composition, e.g., a lotion. Non-dispersible nonwoven webs are comprised of nonwoven fibrous material bonded with a self-crosslinkable binder. Primarily, the fibrous materials are comprised of cellulose wood pulp fibers, typically with an added amount of textile fibers to enhance wet and dry strength. Typically, the wood pulp fibers comprise about 75-100 wt % and the textile fibers about 0-25 wt % of the nonwoven substrate. The preferred textile fibers include rayon, cotton, wool, acetate, or tencel fibers.

Wood pulp (alone or blended with natural or synthetic fibers) can be processed by dry (air-laid, carded, rando) or wet-laid processes to produce nonwovens webs. Nonwoven webs produced by air-laid processes are preferred due to minimal hydrogen bonding of fibers in the finished product compared to wet-laid nonwovens. Air-laid processes impart little or no inherent integrity to the web which must be overcome with agitation to achieve complete disintegration of the web.

The initial treatment in the formation of dispersible pre-moistened wipes is to coat or impregnate the nonwoven web with the water soluble or water redispersible binder. This may be done by (1) immersing the webs, or running lengths of the web in an aqueous composition of the water redispersible latex polymeric binder, especially an aqueous polymer emulsion stabilized with PVOH as the protective colloid or (2) applying such water soluble or redispersible polymeric binder to the surfaces of the nonwoven web of fibers by spraying, by padding, by roller, or other types of applicator. Following drying, the treated nonwoven web may be then cut to desired sized sheets for the intended use. Coarse, individual sheets precut to desired size may be treated with the aqueous PVOH or polymer emulsions and then dried.

The initial treatment in the formation of non-dispersible premoistened wipes is to coat or impregnate the nonwoven web with the self-crosslinkable binder. This may be done by (1) immersing the webs, or running lengths of the web in an aqueous composition of the self-crosslinkable latex polymeric binder, especially an aqueous polymer emulsion containing NMA either with or without acrylamide or (2) applying such a self-crosslinkable latex polymeric binder to the surfaces of the nonwoven web of fibers by spraying, by padding, by roller, or other types of applicator. Following drying, the treated nonwoven web may be heated to a higher temperature to effect full cure of the self-crosslinkable moieties then cut to desired sized sheets for the intended use.

The improvement in the dispersible pre-moistened wipes resides in a water soluble polymeric blend as said water redispersible latex polymeric binder comprised of:

(1) a water redispersible latex polymeric binder; (2) poly(vinyl alcohol); and (3) poly(acrylic acid). The amounts of water redispersible latex polymer, poly (vinyl alcohol) and poly(acrylic acid), on a dry weight basis, are set forth in the table below.

| Ingredient | Dry Weight % | Preferred Dry Weight % |
|---|---|---|
| Water Redispersible Latex Polymer | 65-85 | 68-78 |
| Poly(vinyl alcohol) | 13-30 | 20-28 |
| Poly(acrylic acid) | 1-7 | 2-5 |

The water redispersible latex polymeric binder for dispersible nonwoven products is one that is generally non-crosslinking, e.g., it does not contain polymerized NMA units which cross link to the extent the polymer becomes relatively nonredispersible. Most desirably the water redispersible latex polymer contains PVOH as the protective colloid and a component of the stabilizing system in its preparation by aqueous emulsion polymerization. PVOH stabilized vinyl acetate and vinyl acetate based polymers, e.g., VAE polymer emulsions are preferred due to their ease of water dispersibility. While the water redispersible polymer can be a homo-poly(vinyl acetate), these formulations tend not to have the desired degree of elongation required for typical airlaid nonwoven production.

Water redispersible latex polymeric binders that can be used include but are not limited to vinyl acetate based polymers, e.g., VAE polymers stabilized with PVOH where the Tg is between −45° C. and 30° C. There can also be low levels of other monomers polymerized into the backbone. These monomers can include (meth)acrylic acid, crotonic acid, alkyl (meth)acrylates where the alkyl group is $C_1$-$C_{12}$, linear or branched, di- or mono-alkyl maleates where the alkyl group is $C_1$-$C_{12}$, linear or branched, (meth)acrylamide, di- or mono-alkyl substituted (meth)acrylamides where the alkyl group is $C_1$-$C_{12}$, linear or branched, vinyl esters of alkanoic acids where the alkyl group is $C_1$-$C_{12}$, linear or branched, propylene, vinyl chloride, and vinyl ethylene carbonate.

The PVOH employed as a component of the blend can have a degree of hydrolysis from 75 to 96 mole %; preferably, 87 to 89 mole %. It can also have a degree of hydrolysis of greater than 96 mole %. It is preferred to use PVOH having a high molecular weight; degree of polymerization (DPn) of 600 to 2500 or more. Increasing the degree of hydrolysis of the PVOH tends to result in a web which redisperses much slower. This property does not preclude the dispersions from being appropriate binders but they are less desirable in some applications. PVOH products are available commercially from Celanese Chemical Company and bear the tradename Celvol.

The improvement in the non-dispersible nonwoven webs resides in a water dispersed polymeric blend as said self-crosslinkable latex polymeric binder comprised of: (1) a self-crosslinkable latex polymeric binder and (2) poly (acrylic acid). The amounts of self-crosslinkable latex polymer and poly(acrylic acid), on a dry weight basis, are set forth in the table below.

| Ingredient | Dry Weight % | Preferred Dry Weight % |
|---|---|---|
| Self-crosslinkable latex polymer | 90-99.9 | 94-99 |
| Poly(acrylic acid) | 0.1-10 | 1-6 |

The self-crosslinkable latex polymeric binder for non-redispersible nonwoven products is one that contains polymerized NMA units which cross link to the extent the polymer becomes relatively non-redispersible. Most desirably the self-crosslinkable latex polymer contains either NMA; a mixture of NMA and acrylamide (commercially known as NMA-LF or MAMD); acrylamidoglycolic acid, (AGA); acrylamidobutyraldehyde diethyl acetal; acrylamidobutyraldehyde dimethyl acetal; methyl acrylamidoglycolate methyl ether; isobutylmethylol acrylamide and the like.

NMA and mixtures of NMA and acrylamide are the crosslinkers of choice and are the ones of commercial choice for polymers of reduced free formaldehyde emissions. The monomers are polymerized by aqueous emulsion polymerization.

The self-crosslinkable latex polymeric binders that can be used include but are not limited to vinyl acetate based polymers, e.g., VAE polymers stabilized with either PVOH, surfactants, surfactants in conjunction with a protective colloid which may be either PVOH or modified hydroxyethyl cellulose, where the Tg of the dispersion polymers is between −45° C. and 30° C. There can be levels of other co-monomers also polymerized into the backbone. These monomers can include (meth)acrylic acid, crotonic acid, alkyl (meth)acrylates where the alkyl group is $C_1$-$C_{12}$, linear or branched, di- or mono-alkyl maleates where the alkyl group is $C_1$-$C_{12}$, linear or branched, (meth)acrylamide, di- or mono-alkyl substituted (meth)acrylamides where the alkyl group is $C_1$-$C_{12}$, linear or branched, vinyl esters of alkanoic acids where the alkyl group is $C_1$-$C_{12}$, linear or branched, propylene, vinyl chloride, and vinyl ethylene carbonate. These polymers can also be free of vinyl acetate and ethylene.

The term poly(acrylic acid) is intended to refer to polymer having a major portion (e.g., at least 50%) and preferably at least 90% of polymerized acrylic acid units in the polymer backbone. Often poly(acrylic acid) is formed by the hydrolysis of poly(acrylamide) and thus residual acrylamide can be present in the polymer. The polymer can also be of any molecular weight but a preferred number average molecular weight range for the poly(acrylic acid) is 100,000 to 500,000 Daltons. Examples of commercially appropriate poly(acrylic acid) include Acumer 1540 and Acumer 1510 which are available from Rohm & Haas or Cyanamer A-15, Cyanamer A-100L, Cyanamer P-21, Cyanamer A-370 available from Cytec Industries, Inc., or Alcosperse 124, Alcosperse 404, Alcosperse 406, Alcosperse 459, Alcosperse 602A and Alcosperse 747 available from Alco Chemical and several grades of poly(acrylic acid) available from Aldrich Chemical Company.

The blend is applied to the fibrous web in an amount which is at least sufficient to bind the fibers together to form a self-sustaining fabric. The blend, calculated on a dry basis, is applied to the fibrous starting web in an amount generally from about 5-50 wt % preferably 15 to 30 wt % in the formation of the nonwoven web. After application of the blend, in aqueous form, the impregnated web is dried.

Pre-moistened wet wipes are packaged in contact with an aqueous composition, e.g., a lotion containing water and a water binding salt. Lotions often include alcohols, preservatives, cleansing agents, fragrances, moisturizers, humectants, surfactants and softeners as well known and practiced in the art.

The amount of the aqueous lotion composition applied to, or in contact with, the nonwoven pre-moistened wipe may range from 150-1000 wt % of the web, preferably 200-400 wt %. The aqueous lotion may comprise conventional levels of water, typically from 40-99 wt % water, and preferably from 60 to 80% water.

A water-binding compound, e.g., insolubilizing salt is incorporated into the aqueous composition or lotion to assist in preventing the dissolution of the water redispersible polymeric binder. The amount of the water-binding materials can range from 3 to about 100 wt %, preferably 5 to 95 wt %, and most preferably 20 to 90 wt %, of the lotion "solids", i.e., the components other than water comprising the aqueous or lotion composition. Expressed as the weight of the lotion, the amount is from about 5 to 15 wt %.

Water binding compounds include ammonium, mono- and polyvalent metal salts of inorganic and organic acids, such as the alkali and alkaline earth metal salts. Suitable metals include the alkali metals lithium, sodium, potassium and the alkaline earth metals magnesium and calcium. Suitable acid moieties include organic acids such as carbonic acid, citric acid, acetic acid and succinic acid and inorganic acids such as phosphoric acid, sulfuric acid and hydrochloric acid. Exemplary materials include sodium chloride, sodium sulfate, ammonium acetate, sodium citrate, sodium carbonate, sodium bicarbonate, sodium lauryl sulfate, disodium laureth sulfosuccinate, sodium laureth sulfate, sodium nonylphenol ethoxylate sulfate, disodium phosphate, sodium carbonate and their potassium counterpart.

The following examples are intended to illustrate various embodiments of the invention and are not intended to restrict the scope thereof.

EXAMPLES

A series of formulations were prepared in a conventional manner and tested for dry, wet, and lotion tensile strength, and redispersibility. In Runs 1-38, a blend was formed based upon 70 to 80 weight parts latex polymer, 20 to 30 weight parts PVOH and 0 to 5 weight parts poly(acrylic acid), all on a dry basis. Runs 39-43 are blends of 95 to 100 weight parts latex polymer and 0 to 5 weight parts poly(acrylic acid), each on a dry basis. The blend was sprayed on a short-fiber cellulosic air-laid fluff pulp substrate to provide a level of from 10 to 20% add on based upon the wet of the substrate. The substrate was dried and rolled. A lotion comprised of water and a water binding sodium sulfate salt was rolled into the web in an amount of about 300% by wet weight of lotion per dry weight of substrate. The results of the tests are shown in the Table.

TABLE

| Run # | Latex Type | Latex % | PVOH Grade | PVOH % | Type of PAA in Binder (MW in Daltons) | % PAA in Binder | Additive in Lotion | Wet wt % $Na_2SO_4$ Additive in Lotion | Dry Tensile (g/in) | Wet Tensile (g/in) | Lotion Tensile (g/in) |
|---|---|---|---|---|---|---|---|---|---|---|---|
| 1 | XX 210 | 80 | C-523 | 20 | — | 0 | $Na_2SO_4$ | 5 | 602.9 | 12.4 | 34.5 |
| 2 | XX 210 | 80 | C-523 | 20 | — | 0 | $Na_2SO_4$ | 10 | 602.9 | 12.4 | 68.7 |
| 3 | XX 210 | 80 | C-523 | 20 | — | 0 | $Na_2SO_4$ | 15 | 602.9 | 12.4 | 86.3 |
| 4 | XX 210 | 80 | C-523 | 20 | Aldrich (250,000) | 2 | $Na_2SO_4$ | 5 | 861.8 | 31.5 | 45.5 |

TABLE-continued

| Run # | Latex Type | Latex % | PVOH Grade | PVOH % | Type of PAA in Binder (MW in Daltons) | % PAA in Binder | Additive in Lotion | Wet wt % $Na_2SO_4$ Additive in Lotion | Dry Tensile (g/in) | Wet Tensile (g/in) | Lotion Tensile (g/in) |
|---|---|---|---|---|---|---|---|---|---|---|---|
| 5 | XX 210 | 80 | C-523 | 20 | Aldrich (250,000) | 2 | $Na_2SO_4$ | 10 | 861.8 | 31.5 | 165.8 |
| 6 | XX 210 | 80 | C-523 | 20 | Aldrich (250,000) | 5 | $Na_2SO_4$ | 5 | 799.7 | 97.5 | 146.0 |
| 7 | XX 210 | 80 | C-523 | 20 | Aldrich (250,000) | 5 | $Na_2SO_4$ | 10 | 799.7 | 97.5 | 165.8 |
| 8 | XX 210 | 80 | C-523 | 20 | Aldrich (450,000) | 2 | $Na_2SO_4$ | 15 | 869 | 31.7 | 105.3 |
| 9 | XX 210 | 80 | C-523 | 20 | Aldrich (450,000) | 5 | $Na_2SO_4$ | 15 | 945 | 100.3 | 195.0 |
| 10 | XX 210 | 80 | C-523 | 20 | Cytec A370 (200,000) | 2 | $Na_2SO_4$ | 15 | 757 | 15.9 | 64.7 |
| 11 | XX 210 | 80 | C-523 | 20 | Cytec A370 (200,000) | 5 | $Na_2SO_4$ | 15 | 772 | 17.7 | 66.3 |
| 12 | XX 210 | 80 | C-523 | 20 | Aldrich (750,000) MW | 2 | $Na_2SO_4$ | 10 | 748.9 | 44.1 | 122.7 |
| 13 | XX 210 | 80 | C-523 | 20 | Aldrich (750,000) | 4 | $Na_2SO_4$ | 10 | 853.5 | 124.0 | 181.4 |
| 14 | XX 210 | 80 | C-523 | 20 | Aldrich (1,250,000) | 2 | $Na_2SO_4$ | 10 | 871.9 | 55.1 | 138.7 |
| 15 | XX 210 | 80 | C-523 | 20 | Aldrich (4,000,000) | 2 | $Na_2SO_4$ | 10 | 885.2 | 60.4 | 125.1 |
| 16 | A-400 | 70 | C-523 | 30 | — | — | $Na_2SO_4$ | 10 | 662.4 | 15.0 | 68.0 |
| 17 | A-400 | 70 | C-523 | 30 | Aldrich (250,000) | 2 | $Na_2SO_4$ | 10 | 727.3 | 21.0 | 93.9 |
| 18 | A-400 | 70 | C-523 | 30 | Aldrich (250,000) | 5 | $Na_2SO_4$ | 10 | 843.9 | 79.6 | 142.3 |
| 19 | A-400 | 70 | C-523 | 30 | Aldrich (400,000) | 2 | $Na_2SO_4$ | 10 | 698.6 | 26.2 | 110.5 |
| 20 | A-400 | 70 | C-523 | 30 | Aldrich (400,000) | 5 | $Na_2SO_4$ | 10 | 892.4 | 62.7 | 183.9 |
| 21 | XX 210 | 80 | C-523 | 20 | Acumer 1540 (200,000) | 5 | $Na_2SO_4$ | 5 | 593.5 | 46.9 | 52.3 |
| 22 | XX 210 | 80 | C-523 | 20 | Acumer 1540 | 5 | $Na_2SO_4$ | 10 | 593.5 | 46.9 | 104.1 |
| 23 | XX 210 | 80 | C-425 | 20 | — | 0 | $Na_2SO_4$ | 5 | 516.2 | 20.3 | 44.8 |
| 24 | XX 210 | 80 | C-425 | 20 | — | 0 | $Na_2SO_4$ | 10 | 516.2 | 20.3 | 77.8 |
| 25 | XX 210 | 80 | C-425 | 20 | Acumer 1540 | 5 | $Na_2SO_4$ | 5 | 600.3 | 107.7 | 124.6 |
| 26 | XX 210 | 80 | C-425 | 20 | Acumer 1540 | 10 | $Na_2SO_4$ | 10 | 600.3 | 107.7 | 141.2 |
| 27 | XX 210 | 70 | C-425 | 30 | — | 0 | $Na_2SO_4$ | 5 | 559.0 | 19.7 | 64.4 |
| 28 | XX 210 | 70 | C-425 | 30 | — | 0 | $Na_2SO_4$ | 7.5 | 559.0 | 19.7 | 78.4 |
| 29 | XX 210 | 70 | C-425 | 30 | Acumer 1540 | 5 | $Na_2SO_4$ | 5 | 748.4 | 94.8 | 139.6 |
| 30 | XX 210 | 70 | C-425 | 30 | Acumer 1540 | 5 | $Na_2SO_4$ | 7.5 | 748.4 | 94.8 | 151.5 |
| 31 | A-400 | 70 | C-425 | 30 | — | 0 | $Na_2SO_4$ | 5.0 | 487.9 | 13.5 | 42.1 |
| 32 | A-400 | 70 | C-425 | 30 | — | 0 | $Na_2SO_4$ | 7.5 | 487.9 | 13.5 | 49.7 |
| 33 | A-400 | 70 | C-425 | 30 | Acumer 1540 | 2 | $Na_2SO_4$ | 5.0 | 800.7 | 13.2 | 68.8 |
| 34 | A-400 | 70 | C-425 | 30 | Acumer 1540 | 2 | $Na_2SO_4$ | 7.5 | 800.7 | 13.2 | 146.2 |
| 35 | A-400 | 70 | C-523 | 30 | Acumer 1540 | 1 | $Na_2SO_4$ | 7.5 | 971.8 | 18.2 | 92.6 |
| 36 | A-400 | 70 | C-418 | 30 | Acumer 1540 | 2 | $Na_2SO_4$ | 7.5 | 866 | 24.4 | 117.7 |
| 37 | A-315 | 70 | C-523 | 30 | Acumer 1540 | 2 | $Na_2SO_4$ | 7.5 | 1105.5 | 25.9 | 113.4 |
| 38 | A-315 | 70 | C-418 | 30 | Acumer 1540 | 2 | $Na_2SO_4$ | 7.5 | 1100.9 | 33.3 | 127.4 |
| 39 | A-192 | 100 | — | — | Acumer 1540 | 0 | $Na_2SO_4$ | 7.5 | 617.4 | 243.9 | 240 |
| 40 | A-192 | 95 | — | — | Acumer 1540 | 5 | $Na_2SO_4$ | 7.5 | 886.0 | 357.5 | 350 |
| 41 | A-192 | 100 | — | — | Acumer 1540 | 0 | $Na_2SO_4$ | 7.5 | 738.8 | 364.4 | 380.9 |
| 42 | A-192 | 98 | — | — | Acumer 1540 | 2 | $Na_2SO_4$ | 7.5 | 842.9 | 363.1 | 399.1 |

TABLE-continued

| Run # | Latex Type | Latex % | PVOH Grade | PVOH % | Type of PAA in Binder (MW in Daltons) | % PAA in Binder | Additive in Lotion | Wet wt % $Na_2SO_4$ Additive in Lotion | Dry Tensile (g/in) | Wet Tensile (g/in) | Lotion Tensile (g/in) |
|---|---|---|---|---|---|---|---|---|---|---|---|
| 43 | A-192 | 95 | — | — | Acumer 1540 | 5 | $Na_2SO_4$ | 7.5 | 907 | 399.5 | 426.4 |

XX-210 = VINAC 210 poly(vinyl acetate) polymerized in the presence of poly(vinyl alcohol) having a percent hydrolysis from 87 to 89%.
C-523 = Celvol 523 poly(vinyl alcohol) having a percent hydrolysis from 87 to 89%.
A-400 = AIRFLEX 400 vinyl acetate/ethylene polymer formed in the presence of poly(vinyl alcohol) as the protective colloid.
A-315 = AIRFLEX 315 vinyl acetate/ethylene polymer formed in the presence of poly(vinyl alcohol) as the protective colloid.
C-425 = Celvol 425 poly(vinyl alcohol) having a percent hydrolysis of 96%.
C-418 = Celvol 418 poly(vinyl alcohol) having a percent hydrolysis of 92%.
A-192 = AIRFLEX 192 vinyl acetate/ethylene/N-methylol acrylamide polymer.

Runs 1-3 in the Table are provided to illustrate comparisons for the various embodiments of the invention. These results show that the lotion tensile increases with an increase in the amount of water binding salt, i.e., sodium sulfate, present in the emulsion. A problem with higher levels of salt is the stinging sensation associated on contact with the skin.

Runs 4-7 compared the effect of a low molecular weight poly(acrylic acid) when incorporated into the blend for enhancing wet and dry tensile strength. Run 4 when compared to Run 1 shows an improvement in lotion tensile with acceptable wet tensile, i.e., tensile strength approximating conditions of flushing. Run 5 shows a dramatic increase in lotion tensile strength with similar wet tensile to Run 4. When the level of poly(acrylic acid) is increased to 5% in the blend, lotion and wet tensile are increased. The level of lotion tensile is increased when increasing the level of water binding salt from 5 to 10% but the increase is not as dramatic as at the 2% poly(acrylic acid) level.

Runs 8-9 and 12-15 show the effect of increasing the molecular weight of poly(acrylic acid) compared to Runs 4-7 in which the number average molecular weight of the poly(acrylic acid) is 250,000. The results are comparable but as the molecular weight of the poly(acrylic acid) is increased, handling problems unrelated to wet tensile and lotion tensile are created.

Runs 23 to 36 show the effect of a using different poly(vinyl alcohol) in the blend in combination with a VAE polymer latex compared to the effect of the poly(vinyl acetate) latex. The high hydrolysis Celvol 425 PVOH tends to increase both the wet tensile and lotion tensile strength but to a lesser degree than the PVOH having a lower hydrolysis value. Also, the difference between the lotion tensile and wet tensile is less than that of the lower hydrolysis PVOH, compare Runs 25 and 26 to Runs 6 and 7.

Runs 37 to 38 compare the effect of a different VAE polymer in the blend with the use of poly(vinyl alcohol). The use of Airflex 315 VAE polymer emulsion tends to increase the wet tensile and lotion tensile over the use of Airflex 400 VAE polymer emulsion. Compare Runs 37 and 38 to Runs 35 and 36, respectively.

Runs 39 to 43 show the effect of adding a poly(acrylic acid) to a self-crosslinking VAE polymer. AIRFLEX® 192 is an N-methylol acrylamide/acrylamide containing VAE polymer emulsion. When poly(acrylic acid) is added to AIRFLEX192 VAE, the wet tensile increases over the control. Compare Run 40 to Run 39 and Runs 42 and 43 to Run 41.

What is claimed is:

1. In a packaged pre-moistened flushable wet wipe comprising a web of nonwoven fibers bonded with a water redispersible polymeric binder in contact with an aqueous composition containing a water binding salt, the improvement which comprises:

employing a blend of polymeric components as said water redispersible polymeric binder, said blend comprised of (on a dry weight basis):

(a) from 65 to 85 percent by weight of a water redispersible latex polymer;

(b) from 13 to 30 percent by weight of poly(vinyl alcohol); and, (c) from 1 to 7 percent by weight of poly(acrylic acid).

2. The wet wipe of claim 1 in which the aqueous composition comprises 40 to 99 percent by weight water.

3. The wet wipe of claim 1 in which the water redispersible latex polymer is formed by emulsion polymerization and poly(vinyl alcohol) is employed as a component of the stabilizing system for the emulsion polymerization.

4. The wet wipe of claim 3 in which the water-binding salt is an ammonium, alkali metal or alkaline earth metal salt of carbonic acid, citric acid, acetic acid, succinic acid, phosphoric acid, sulfuric acid or hydrochloric acid.

5. The wet wipe of claim 4 in which the water-binding salt is an ammonium, sodium or potassium salt of sulfuric acid.

6. The wet wipe of claim 5 wherein the aqueous composition is comprised of from 80 to 90 percent by weight water.

7. The wet wipe of claim 1 wherein the water redispersible latex polymer is present in an amount from 68 to 78 percent by weight.

8. The wet wipe of claim 7 wherein the poly(vinyl alcohol) has a degree of hydrolysis of from 75 to 96 percent.

9. The wet wipe of claim 8 wherein the poly(vinyl alcohol) in the blend is from 20 to 28% by weight.

10. The wet wipe of claim 9 wherein the poly(acrylic acid) in the blend is from 2 to 5% by weight.

11. The wet wipe of claim 10 wherein the water redispersible polymer emulsion is poly(vinyl acetate).

12. The wet wipe of claim 11 in which the water redispersible latex polymer is an emulsion polymerized vinyl acetate/ethylene polymer polymerized in the presence of poly(vinyl alcohol).

13. The wet wipe of claim 12 in which the poly(vinyl alcohol) has a degree of hydrolysis of from 87 to 89% and a degree of polymerization ranging from 600 to 2500.

14. In a nonwoven product formed by bonding a web of nonwoven fibers with a water dispersible polymeric binder, the improvement which comprises:

employing a water dispersible polymeric binder composition comprised of a blend, said blend comprised of (on a dry weight basis):

(a) from 90 to 99.9 percent by weight of a self-crosslinkable latex polymer; and (b) from 0.1 to 10 percent by weight of poly(acrylic-acid).

15. The nonwoven product of claim 14 wherein the self-crosslinkable latex polymer has a Tg of −45° C. to 30° C.

16. The nonwovens product of claim 14 wherein the self-crosslinkable latex polymer is a vinyl acetate based latex polymer.

17. The nonwoven product of claim 14 wherein the self-crosslinkable latex polymer is comprised of emulsion polymerized units of vinyl acetate, ethylene, and N-methylol acrylamide.

18. The nonwoven product of claim 14 wherein the blend comprises 94 to 99% by weight of a self-crosslinkable latex polymer.

19. The nonwoven product of claim 18 wherein the blend comprises 1 to 6% by weight of poly(acrylic acid).

20. The nonwoven product of claim 14 wherein the self-crosslinkable latex polymer is comprised of emulsion polymerized monomers stabilized with surfactants, protective colloids, or a combination of surfactants and protective colloids.

* * * * *